US010169985B1

(12) United States Patent
Rader

(10) Patent No.: US 10,169,985 B1
(45) Date of Patent: Jan. 1, 2019

(54) METHOD AND SYSTEM FOR COORDINATED CONTROL OF MULTIPLE MOBILE COMMUNICATION DEVICES

(71) Applicant: CUE Audio, LLC, Denver, CO (US)

(72) Inventor: Jameson Rader, Ralston, NE (US)

(73) Assignee: CUE Audio, LLC, Denver, CO (US)

( * ) Notice: Subject to any disclaimer, the term of this patent is extended or adjusted under 35 U.S.C. 154(b) by 0 days.

(21) Appl. No.: 15/361,352

(22) Filed: Nov. 25, 2016

Related U.S. Application Data

(60) Provisional application No. 62/259,334, filed on Nov. 24, 2015.

(51) Int. Cl.
*G08C 23/02* (2006.01)

(52) U.S. Cl.
CPC ..... *G08C 23/02* (2013.01)

(58) Field of Classification Search
CPC .... G08C 23/02; G08C 17/02; G08C 2201/31; G08C 17/00; G08C 23/04; G08C 2201/20; G08C 2201/21
USPC ..... 367/197
See application file for complete search history.

(56) References Cited

U.S. PATENT DOCUMENTS

| | | | | |
|---|---|---|---|---|
| 8,499,038 | B1 * | 7/2013 | Vucurevich | H04W 4/21 709/204 |
| 9,454,789 | B2 * | 9/2016 | Lord | H04N 21/42203 |
| 9,629,220 | B2 * | 4/2017 | Panopoulos | F21V 14/02 |
| 9,747,367 | B2 * | 8/2017 | Benattar | H04R 1/1083 |
| 9,940,508 | B2 * | 4/2018 | Kaps | A63F 13/00 |
| 2012/0134238 | A1 | 5/2012 | Surprenant et al. | |
| 2015/0081071 | A1 | 3/2015 | Lea et al. | |
| 2015/0113094 | A1 | 4/2015 | Williams et al. | |

* cited by examiner

*Primary Examiner* — Mark Blouin
(74) *Attorney, Agent, or Firm* — Suiter Swantz pc llo

(57) ABSTRACT

A method for coordinating multiple mobile devices includes generating, with one or more processors of a controller, an inaudible audio signal including one or more audio triggering patterns. The method also includes outputting, with a speaker unit, the inaudible audio signal including one or more audio triggering patterns to one or more mobile devices, wherein the one or more triggering patterns correspond with one or more actions executable by the one or more mobile devices.

35 Claims, 9 Drawing Sheets

METHOD AND SYSTEM FOR COORDINATED CONTROL OF MULTIPLE MOBILE COMMUNICATION DEVICES

CROSS-REFERENCE TO RELATED APPLICATION

The present application claims benefit under 35 U.S.C. § 119(e) and constitutes a regular (non-provisional) patent application of U.S. Provisional Application Ser. No. 62/259,334, filed Nov. 24, 2015, entitled METHOD AND SYSTEM FOR COORDINATED CONTROL OF MULTIPLE MOBILE COMMUNICATION DEVICES, naming Jameson Rader as the inventor, which is incorporated herein by reference in the entirety.

TECHNICAL FIELD

The present invention generally relates to audio signal processing, and, more particularly, to the generation and output of complex inaudible audio signals for triggering actions on receiving mobile devices.

BACKGROUND

There is a desire to enhance entertainment events, such as sporting events, musical concerts and the like, with crowd interaction. One such way to provide improved crowd interaction is through the use of the individual computing devices (e.g., smartphones) carried by members of the crowd. Previous systems attempting mass synchronization of a large body of computing devices lack adequate precision and control, appearing too randomized and asynchronous. Such methods are inadequate in a number of ways. For example, such systems may cause devices nearest to the control signal source (e.g., stage) to appear more vibrant than those devices located at a more remote distance. Such systems lack the dynamism required to control more than one aspect of the device. The extreme precision required to initiate sufficiently simultaneous functions, such as harmonized audio or in-synch LED flashes, if lacking, can render the audio unrecognizable and the LED flashes ill-timed and irregular. Such methods may also be impacted by both the noise level of the environment itself (e.g., loud noise at music concert or sports venue) and the music they augment. Therefore, it is desirable to provide a method and system that cures the deficiencies of the previous approaches identified above.

SUMMARY

A method for coordinated control of multiple mobile devices is disclosed, in accordance with one or more embodiments of the present disclosure. In one embodiment, the method includes generating, with one or more processors of a controller, an inaudible audio signal including one or more audio triggering patterns. In another embodiment, the method includes outputting, with a speaker unit, the inaudible audio signal including one or more audio triggering patterns to one or more mobile devices, wherein the one or more triggering patterns correspond with one or more actions executable by the one or more mobile devices.

A method for coordinated control of multiple mobile devices is disclosed, in accordance with one or more embodiments of the present disclosure. In one embodiment, the method includes receiving, with a first mobile communication device, an inaudible audio signal from a speaker unit, wherein the inaudible audio includes one or more audio triggering patterns. In another embodiment, the method includes transforming at least a portion of the inaudible audio signal to a transformed signal containing a set of frequency-amplitude vectors. In another embodiment, the method includes analyzing the transformed inaudible audio signal to identify the one or more audio triggering patterns in the transformed signal. In another embodiment, the method includes, upon identifying the one or more audio triggering patterns, executing one or more actions of one or more control sequences on the first mobile device associated with the one or more audio triggering patterns.

A system for coordinated control of multiple mobile devices is disclosed, in accordance with one or more embodiments of the present disclosure. In one embodiment, the system includes a controller. In another embodiment, the controller includes one or more processors configured to execute a set of program instructions stored in memory, wherein the set of program instructions cause the one or more processors to generate an inaudible audio signal including one or more ultrasonic audio triggering patterns. In another embodiment, the system includes a speaker unit. In one embodiment, the speaker unit is communicatively coupled to the one or more processors of the controller. In another embodiment, the speaker unit is configured to output the inaudible audio signal including the one or more ultrasonic audio triggering patterns to one or more mobile devices, wherein the one or more ultrasonic triggering patterns correspond with one or more actions executable by the one or more mobile devices.

A device is disclosed, in accordance with one or more embodiments of the present disclosure. In one embodiment, the device includes a microphone. In another embodiment, the device includes one or more processors. In another embodiment, the device includes memory, wherein the one or more processors are configured to execute a set of program instructions stored in the memory. In another embodiment, the set of program instructions are configured to cause the one or more processors to: transform at least a portion of an inaudible audio signal received by the microphone to a transformed signal containing a set of frequency-amplitude vectors, analyze the transformed inaudible audio signal to identify one or more ultrasonic audio triggering patterns in the transformed signal; and, upon identifying the one or more ultrasonic audio triggering patterns, executing one or more actions of one or more control sequences on the device associated with the one or more ultrasonic audio triggering patterns.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1:
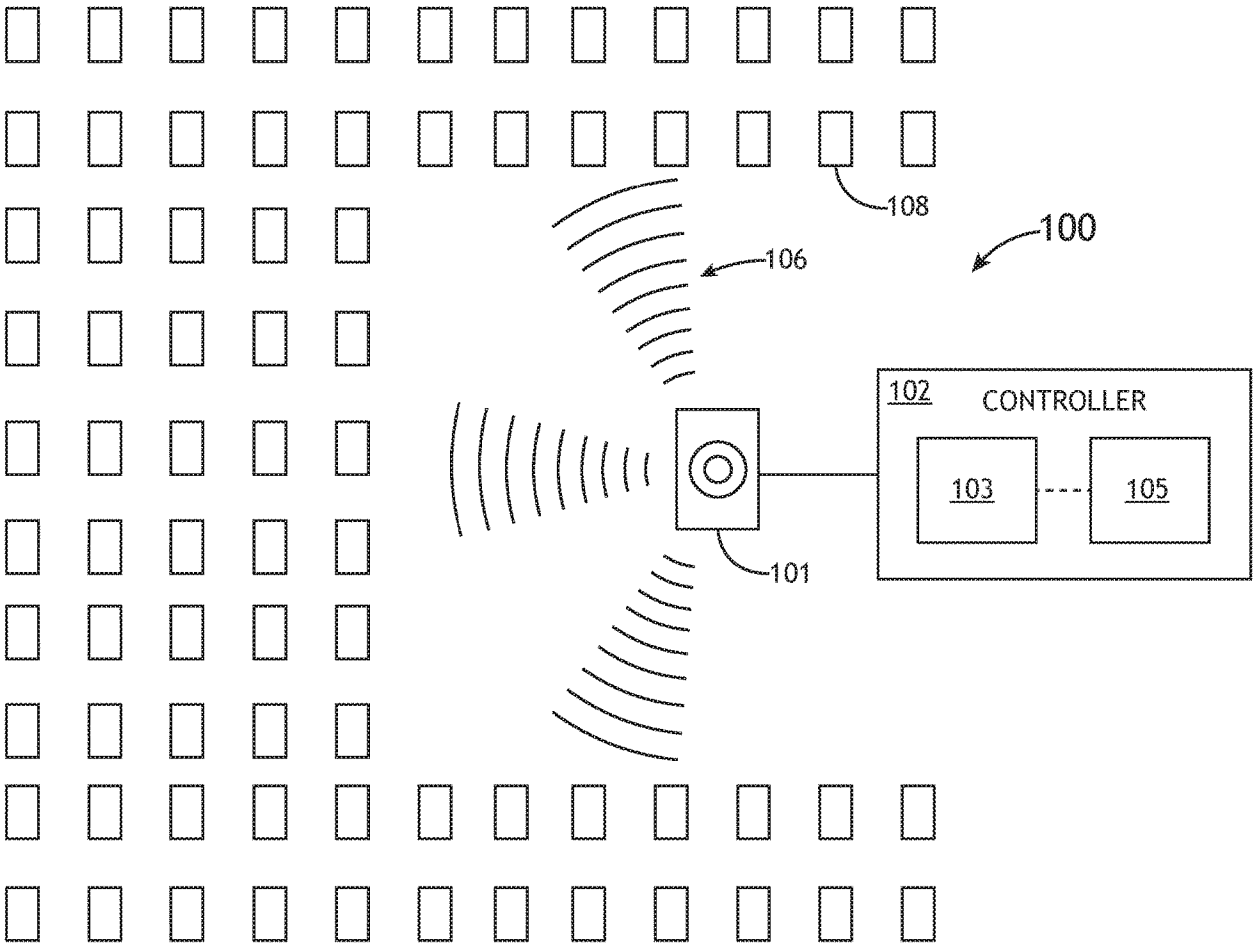
FIG. 1 illustrates a conceptual view of a system for coordinated control of multiple mobile devices, in accordance with one or more embodiments of the present disclosure.

Reference will now be made in detail to the subject matter disclosed, which is illustrated in the accompanying drawings.

Referring generally to FIGS. 1 through 3F, a system and method for coordinated control of mobile devices via an inaudible control signal are described in accordance with the present disclosure.

Some embodiments of the present disclosure relate to the enhancement of an event experience, such as, but not limited to, a concert or sporting event. For example, embodiments of the present disclosure may serve to selectively activate and/or control various functions/actions of one or more mobile devices, such as, but not limited to, the LED flash, vibrational elements (e.g., actuator(s)), a display, or other functions of a mobile device at specified moments following the initialization of the timeline of the device. Additional embodiments of the present disclosure serve to aggregate these individual device effects across a large number of devices in an audience (or other group) to carry out large scale synchronized and/or coordinated visual and/or audio effects. In this regard, a group of heterogeneous devices, such as various models of iOS and ANDROID smartphones, may appear to have a homogenous and/or synchronized output.

Other embodiments of the present disclosure are directed to the generation, output and receiving of inaudible audio signals containing pre-selected triggering patterns. The triggering patterns may be embedded in a given audio signal at frequency regimes in the ultrasonic range so that they are not heard by users and so that they do not experience large amounts of interference.

In some embodiments, one or more triggering patterns or a single triggering tone may be used to carry out the coordinated control of multiple mobile devices (e.g., smartphone, tablet, wearable communications device and the like) utilizing a sound transmitting device and corresponding sound receiving devices. The sound transmitting device, such as a speaker (e.g., loudspeaker or other speaker system), emits one or more selected audio signals. These signals, whether a single triggering tone or a triggering pattern may initiate a sequence of actions (e.g., serial actions), whereby the receiving mobile device or devices perform the actions according to a control sequence (e.g., timeline) embedded in the memory (e.g., Random Access Memory (RAM)) of the mobile device. The control sequence may be transmitted to the mobile devices prior to a given event via the installation and/or update to a mobile application (app) running on the mobile device. These actions may cause an activation and/or adjustment of one or more visual and/or audio output components of the one or more mobile devices. For example, the signal or pattern may activate and/or adjust a display (e.g., brightness level, color and etc.), the speaker, LED flash, camera, vibrate function and the like of one or more of the mobile devices. Further, the control sequence embedded in each of the one or more mobile devices (or retrievable from a server) allows for the coordinated and/or synchronous control of audio and/or visual output of the multiple mobile devices. To achieve mass synchronization, the embodiments of the present disclosure are resilient to noisy environments, musical accompaniment, and spatial dispersion.

The transmission of audio signals for device control is generally described in U.S. Patent Publication No. 2015/0081071 to Lea et al., published on Mar. 19, 2015, which is incorporated herein by reference in the entirety. The generation of an acoustic carrier signal is described in U.S. Patent Publication No. 2012/0134238 to Surprenant et al., published on May 31, 2012, which is incorporated herein by reference in the entirety. A content management method that uses a portable device to detect acoustic signals is described in U.S. Patent Publication No. 2015/0113094 to Williams et al., published on Apr. 23, 2015, which is incorporated herein by reference in the entirety. A system for providing content to a user is described in U.S. Pat. No. 8,532,644 to Bell et al., issued on Sep. 10, 2013; U.S. Pat. No. 8,401,569 to Bell et al., issued on Mar. 19, 2013; and U.S. Patent Publication No. 2013/0079058 to Bell et al., published on Mar. 28, 2013, which are each incorporated herein by reference in the entirety.

FIG. 1 illustrates a system 100 for coordinated control of multiple mobile devices 108, in accordance with one or more embodiments of the present disclosure. In one embodiment, the system 100 includes a controller 102 and speaker unit 101 (e.g., speaker, control circuitry to control speaker output, etc.). The controller 102 may include one or more processors 103 configured to execute a set of program instructions stored in memory 105.

In one embodiment, the one or more processors 103 of controller 102 are configured to generate an inaudible audio signal including one or more audio triggering patterns. In this regard, the one or more audio triggering patterns may serve as a "digital fingerprint" to control one or more mobile devices 108 that receive the inaudible audio signal. The inaudible signal containing the one or more triggering patterns may be formed by any audio synthesis technique known in the art.

In one embodiment, the inaudible signal containing one or more triggering patterns may be generated as a stand-alone signal. In another embodiment, the inaudible signal containing one or more triggering patterns is appended to an audible signal. For example, the inaudible signal containing one or more triggering patterns may be appended to a selected portion of an audio track present at an event, such as the audio track associated with a light show. For instance, a 2 second pad may be added at the front portion of the audio track, which embeds the one or more triggering patterns (e.g., ultrasonic triggering pattern(s)) to the audio track file (e.g., WAV file). This appended audio track may then be presented at the event, allowing the audio triggering patterns to be distributed to multiple receiving multiple devices 108, thereby providing for the coordinated/synchronous control of the output of the various receiving devices 108.

Further, the one or more processors 103 of controller 102 are communicatively coupled to the speaker unit 101 (e.g., wireline or wireless coupling) so as to transmit one or more control signals to the speaker unit 101 to direct to the speaker of the speaker unit 101 to emit an audio signal containing the one or more triggering patterns, as described further herein. It is noted that the controller 102 may include any computation device known in the art suitable for controlling output of a speaker unit or set of speaker units. For example, the controller 102 may be embodied as a computer (e.g., desktop computer, laptop computer), a tablet device, a smartphone, a personal digital assistant (PDA), or a customized controller. Further, the controller 102 may be housed in the same housing as the speaker unit 101 to form an integrated speaker-controller device or the controller 102 may be located remotely from the speaker unit 102.

In another embodiment, the speaker unit 101 may output the inaudible audio signal including one or more audio triggering patterns to one or more mobile devices 108. The one or more triggering patterns correspond with one or more actions/functions executable by the one or more mobile devices 108.

In one embodiment, the audio signal 106 is transmitted by the speaker unit 101 and then received by one or more of the multiple mobile devices 108. In another embodiment, the one or more triggering patterns contained within the one or more audio signals 106 (e.g., signal tone, combination of tones or a permutation of tones) initiates an action or sequence of actions on the mobile devices to carry out a synchronized or coordinated output on the mobile devices 106. In this regard, the receiving mobile device or devices 108 may perform the actions according to a control sequence (e.g., timeline) stored in the memory of the mobile devices 108. In another embodiment, these actions may cause an activation and/or adjustment of one or more visual and/or audio output components of the one or more mobile devices 108. For example, the signal may activate and/or adjust a screen setting (e.g., brightness level, color and etc.), speaker output, LED flash state, camera, vibrate function and the like of one or more of the mobile devices 108. Further, the control sequence stored in memory (e.g., stored in each of the one or more mobile devices 108 or stored on remote server), and activated by the one or more triggering patterns, provides for the coordinated and/or synchronous control of audio and/or visual output of the multiple mobile devices. For example, a synchronous display may include, but is not limited to, the activation of multiple screens or LED flash devices of multiple devices 108 at the same (or very nearly the same) time. By way of another example, a coordinated display may include, but is not limited to, the coordinated activation of groups of screens or LED flash devices of the multiple devices 108 at different (but coordinated) times. In this regard, an output of a first set of the devices 108 may be activated at a first time, while the output of a second set of the devices is not activated until a second time. This process may be repeated for any number of device groups for any number of times. Aggregating the selective activation of the various multiple devices 108 allows system 100 to provide a coordinated dynamic visual output. Such an output, for example, may be coordinated with respect to a sound display (e.g., music, announcement or other sound effect). It is noted that in addition to the brightness level of the screens of the multiple communication devices 108, the color of the screens may also be controlled synchronously or in a coordinated fashion. In some embodiments, where the density of mobile devices 108 is sufficiently high, the system 100 may initiate a control sequence on the mobile devices 108 that transforms the aggregated screens of the mobile communication devices 108 into a large coordinated display, capable of animation effects.

In one embodiment, the one or more mobile devices 108 and speaker unit 101 may be located locally to the controller 102. For example, the speaker unit 101 may be a speaker unit located at an event and located locally with respect to the controller 102, which is also located at the event. In another embodiment, the one or more mobile devices 108 and speaker unit 101 may be located remotely to the controller 102. For example, the speaker unit 101 may be a speaker unit located in a viewer's home (e.g., television speaker, computer speaker, and the like), which then sends the audio signal from the speaker unit 101 to the viewer's mobile device 108. In this regard, the system 100 may deliver the one or more triggering patterns to devices of users that are not in attendance of the given event, allowing them to take part in the activity when viewing on television or listening on the radio.

The one or more processors 103 of controller 102 may include any processing element known in the art. In this sense, the one or more processors 103 may include any microprocessor-type device configured to execute software algorithms and/or instructions. In one embodiment, the one or more processors 103 may be embodied in a desktop computer, mainframe computer system, workstation, image computer, parallel processor, or any other computer system (e.g., networked computer) configured to execute a program configured to operate one or more steps of the present disclosure. In general, the term "processor" may be broadly defined to encompass any device having one or more processing elements, which execute program instructions from a non-transitory memory medium 105. Moreover, different subsystems of the system 100 (e.g., speaker unit) may include processor or logic elements suitable for carrying out at least a portion of the steps described throughout the present disclosure. Therefore, the above description should not be interpreted as a limitation on the present disclosure, but merely an illustration.

The memory 105 may include any storage medium known in the art suitable for storing program instructions executable by the associated one or more processors 103. For example, the memory 105 may include a non-transitory memory medium. For instance, the memory 105 may include, but is not limited to, a read-only memory, a random access memory, a magnetic or optical memory device (e.g., disk), a magnetic tape, a solid state drive and the like. In another embodiment, the memory 105 is configured to store one or more results and/or the output of one or more of the various steps described herein. It is further noted that memory 105 may be housed in a common controller housing with the one or more processors 103. In an alternative embodiment, the memory 105 may be located remotely with respect to the physical location of the one or more processors 103 and controller 102. For instance, the one or more processors 103 of controller 102 may access a remote memory (e.g., server), accessible through a network (e.g., internet, intranet and the like).

Figure 2A:
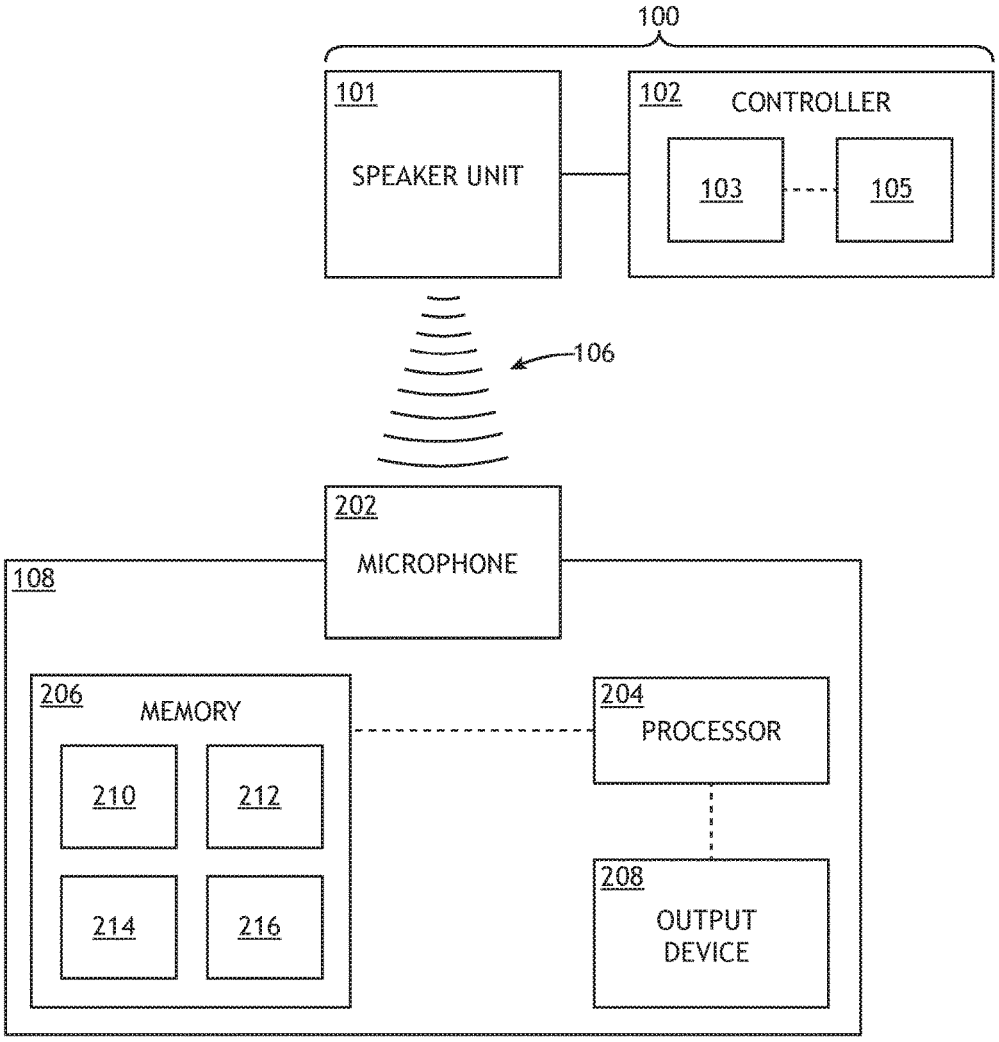
FIG. 2A illustrates a block diagram view of one of the mobile devices, in accordance with one or more embodiments of the present disclosure.

FIG. 2A illustrates a block diagram view of one of the mobile devices 108, in accordance with one or more embodiments of the present disclosure. The one or more mobile devices 108 include a sound receiving device, such as, but not limited to, a microphone 202. In another embodiment, the one or more mobile devices 108 include one or more processors 204, memory 206 and an output device 208. The one or more processors 204 are configured to execute a set of program instructions stored in the memory 206 in order to execute any of the steps of the present disclosure. Further, the memory 206 may maintain one or more databases. For example, memory 206 may maintain a triggering pattern database 210, a pairing database 212, an action database 214 and/or a media database (e.g., images, audio and/or video for display in response to triggering pattern). In another embodiment, the one or more mobile devices 108 include one or more output devices 208 for performing the visual and/or audio display as described throughout the present disclosure.

Figure 2B:
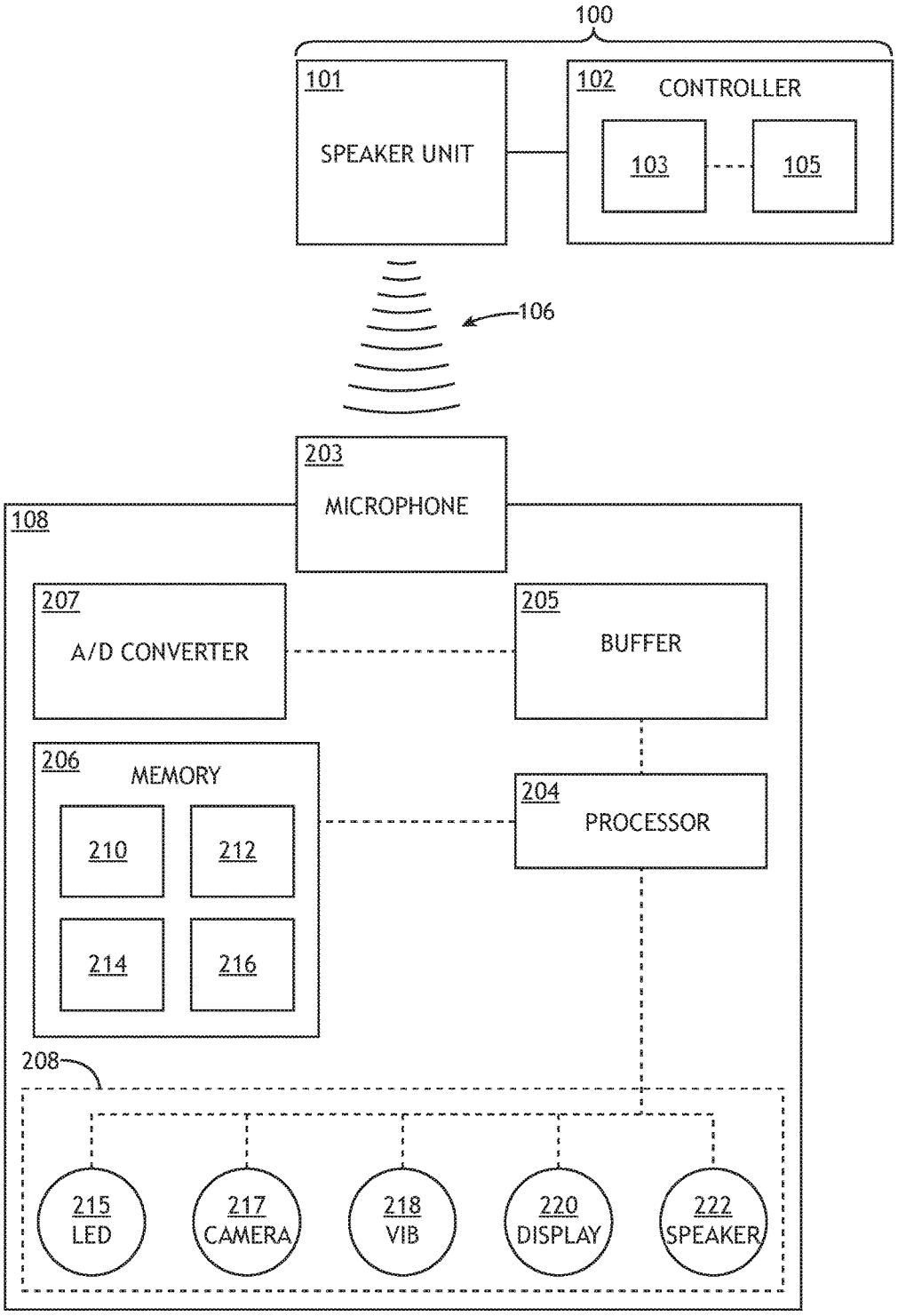
FIG. 2B illustrates a block diagram view of one of the mobile devices, in accordance with one or more embodiments of the present disclosure.

FIG. 2B illustrates a block diagram view of one of the mobile devices 108, in accordance with one or more embodiments of the present disclosure. In this embodiment, the one or more of the mobile devices 108 include an analog-to-digital converter (ADC) 207, the memory 206 (e.g., RAM) and buffer memory 205 for continuously processing audio signals (i.e., sound signals) received from the transmitting speaker unit 101 by the microphone 203. In another embodiment, output devices of the one or more mobile devices 108 include, but are not limited to, an LED flash device 215, a camera 217, a vibrational element 218, a display 220 and/or a speaker 222. In another embodiment, audio and/or images, used for audio and/or visual output are stored in the media library 216 of memory 206.

It is noted that the one or more mobile devices may include any mobile device known in the art, such as, but not limited to, a smartphone, a tablet device, a laptop, a personal digital assistant (PDA), a wearable device (e.g., a fitness tracker, a smartwatch, etc.) or a customized mobile device (e.g., mobile wired device handed out at event).

While much of the present disclosure has focused on the implementation of system 100/mobile device(s) 108 utilizing a triggering pattern in an inaudible signal, this should not be interpreted as a limitation on the scope of the present disclosure. For example, the system 100/mobile device(s) 108 may carry out various embodiments of the present disclosure utilizing a single triggering frequency that is above a selected amplitude threshold. Generally, based on the presence of the triggering pattern (or triggering amplitude of a single tone), the mobile device 108 may activate or adjust the output of one or more of an LED flash device 215, a camera 217, a vibrational element 217, a display 220 and/or a speaker 222.

Figure 3A:
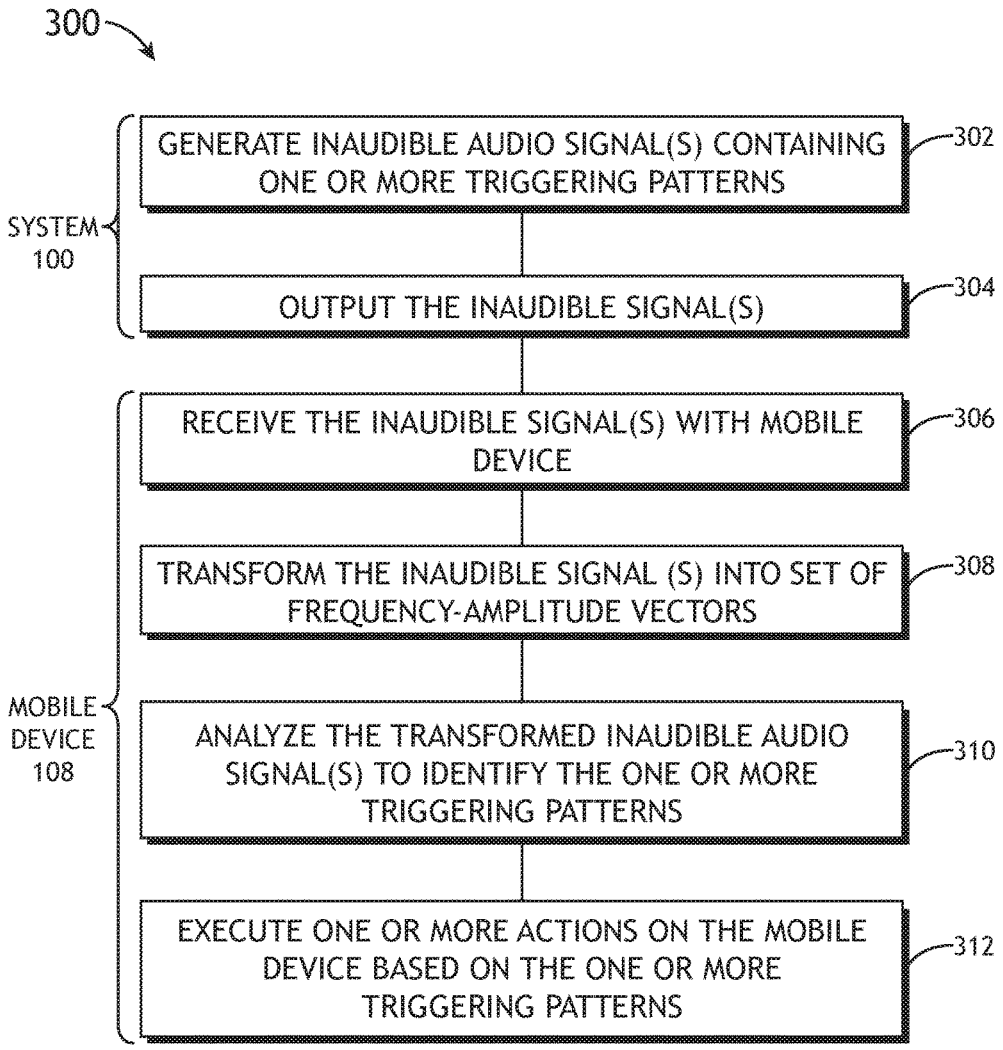
FIG. 3A illustrates a process flow diagram depicting a method of coordinating control of multiple mobile devices, in accordance with one or more embodiments of the present disclosure.

FIG. 3A illustrates a process flow diagram 300 depicting the steps of a method for coordinated control of multiple mobile devices 108, in accordance with one or more embodiments of the present disclosure.

It is noted herein that the steps of method 300 may be implemented all or in part by the system 100 and/or mobile device(s) 108. It is further recognized, however, that the method 300 is not limited to the system 100 and/or mobile device 108 in that additional or alternative system-level embodiments may carry out all or part of the steps of method 300.

In step 302, an inaudible audio signal including one or more audio triggering patterns is generated. In one embodiment, the controller 102 generates one or more inaudible signals containing one or more triggering patterns. The one or more triggering patterns correspond with one or more functions executable by the one or more mobile devices 108. For example, the controller 102 may generate one or more inaudible audio signals containing one or more triggering patterns utilizing any audio synthesis software known in the art. In one embodiment, the inaudible audio signal including the one or more audio triggering patterns may be generated as a stand-alone signal to be emitted by the speaker unit 101. In another embodiment, the inaudible audio signal including the one or more audio triggering patterns may be appended to an audible set of signals, as discussed previously herein.

In one embodiment, the triggering pattern is generated within the frequency range of 14-24 kHz. In another embodiment, the triggering pattern may be generated as an ultrasonic audio signal or a near ultrasonic audio signal. For example, the triggering pattern may be generated within the frequency range of 16-22 kHz. More specifically, the triggering pattern may be generated within the frequency range of 20-21 kHz.

In step 304, the inaudible audio signal including one or more audio triggering patterns is outputted to one or more mobile devices 108. For example, the inaudible audio signal including one or more audio triggering patterns is outputted to one or more mobile devices 108 via one or more speakers (e.g., piezoelectric, magnetostrictive transducers and the like) of the speaker unit 101.

In step 306, the mobile device 108 receives one or more inaudible audio signals containing the one or more audio triggering patterns from the speaker unit 101. For example, the mobile device 108 may sample (e.g., continuously or periodically) for audio signals received from the speaker 101 through the attached microphone 202 of the mobile device 108. The mobile device 108 may sample the incoming inaudible audio signals 106 until it detects one or more audio triggering patterns (as discussed below). It is noted that the present disclosure is not limited to a single mobile device. Rather, the present implementation may be extended to any number of mobile devices, which are synchronized/coordinated using the triggering pattern (or triggering tone) of the inaudible signal. In this regard, all of the steps described throughout the present disclosure may be executed by a first mobile device, a second mobile device, a third mobile device and so on.

In another embodiment, once received by the microphone 203, the one or more inaudible audio signals may undergo analog-to-digital (ND) conversion. For example, as shown in FIG. 2B, the received analog signal(s) may be divided by the A/D converter 207 into a set of segments stored in memory, such as buffer memory 205. It is noted that each stored segment may contain a subset of the inaudible audio signal received during a selected time period.

In step 308, the one or more processors 204 of the mobile device 108 transform the received inaudible signal 106. In one embodiment, the one or more processors 204 of the mobile communications device 108 transform the received inaudible audio signal via one or more selected transforms (or other audio analysis techniques). The one or more processors 204 of the mobile device 108 may extract a set of N frequency-amplitude vectors from the incoming signal 106 (e.g., following digitization) and transform each segment of sampled audio data into a frequency-amplitude vector via the selected transform. In this regard, each segment of the digitized inaudible signal may be transformed into a frequency-amplitude vector, forming a set of N frequency-amplitude vectors for a given audio signal. The set of N frequency-amplitude vectors may be stored in memory 206 of the mobile device 108 for later retrieval.

The one or more processors 204 may apply any transformation technique known in the art of audio analysis to transform the audio signal into a set of frequency-amplitude vectors. For example, the one or more processors 204 may apply a Fast Fourier Transform (FFT) to the received inaudible audio signal to transform the audio signal into a set of frequency-amplitude vectors. Additionally and/or alternatively, the one or more processors 204 may apply a Rasterized Digital Fourier Transform (RFT) to the received inaudible audio signal to transform the audio signal into a set of frequency-amplitude vectors. The RFT may be based on a Goertzel frequency transform, which is a digital signal processing technique for identifying frequency components of an audio signal. By way of another example, the one or more processors 204 may apply a JTRANSFORM (developed by GOOGLE) to the received inaudible audio signal to transform the audio signal into a set of frequency-amplitude vectors. The application of digital transforms suitable for transforming an audio signal into corresponding frequency components is described in U.S. Patent Publication No. 2012/0134238 to Surprenant et al., published on May 31, 2012; and U.S. Patent Publication No. 2015/0081071 to Lea et al., published on Mar. 19, 2015, which are each incorporated above by reference in the entirety.

Figure 3B:
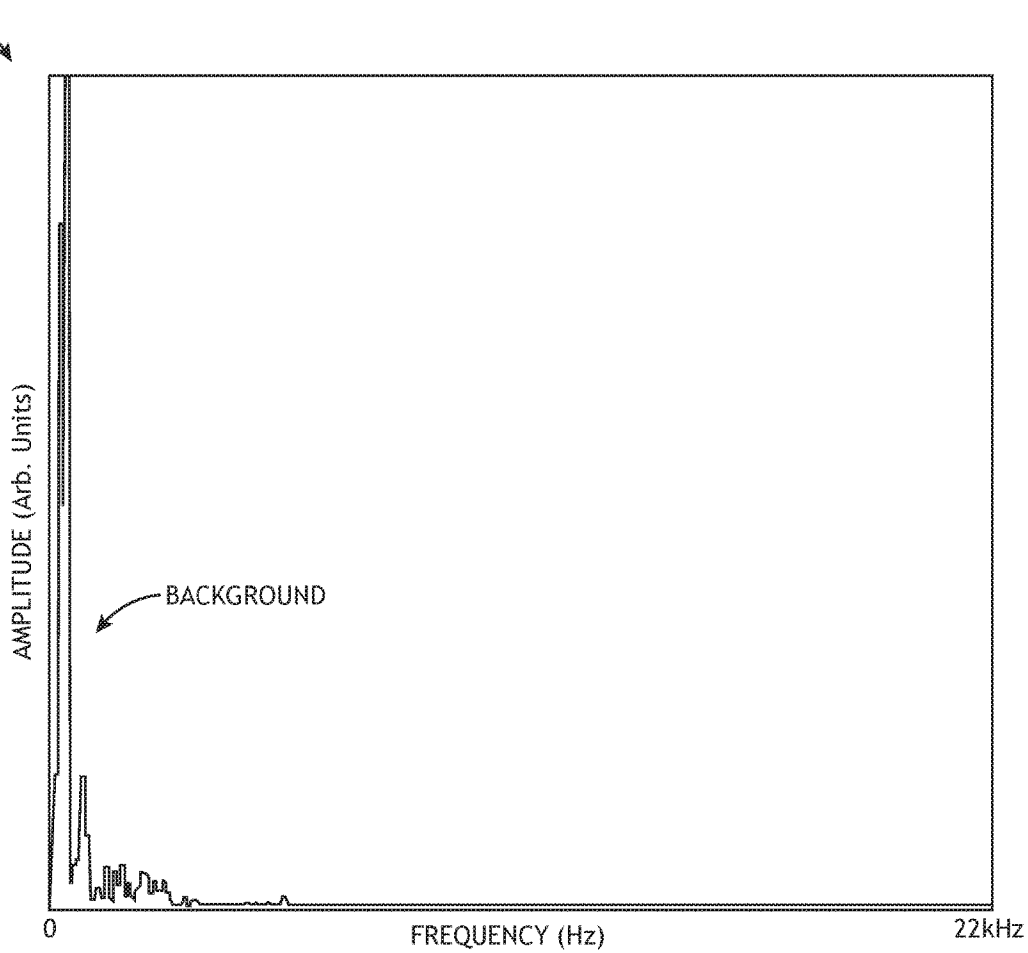
FIG. 3B illustrates a graph of the amplitude of the digital audio signal as a function of frequency in the case where the audio signal contains no triggering pattern, in accordance with one or more embodiments of the present disclosure.

FIG. 3B illustrates a graph 350 of the amplitude of the digital audio signal as a function of frequency in the case where the audio signal does not include a triggering pattern, in accordance with one or more embodiments of the present disclosure. In this regard, the set of N frequency-amplitude vectors are graphically illustrated in graph 350, whereby each frequency "bucket" contains an associated amplitude value. The set of N frequency-amplitude vectors shown in graph 350 is consistent with the audio background signal measured at a sporting event or concert, with the concentration of high amplitude frequency vectors being distributed over frequencies between 0-1000 Hz (labeled "background" in graph 350).

Figure 3C:
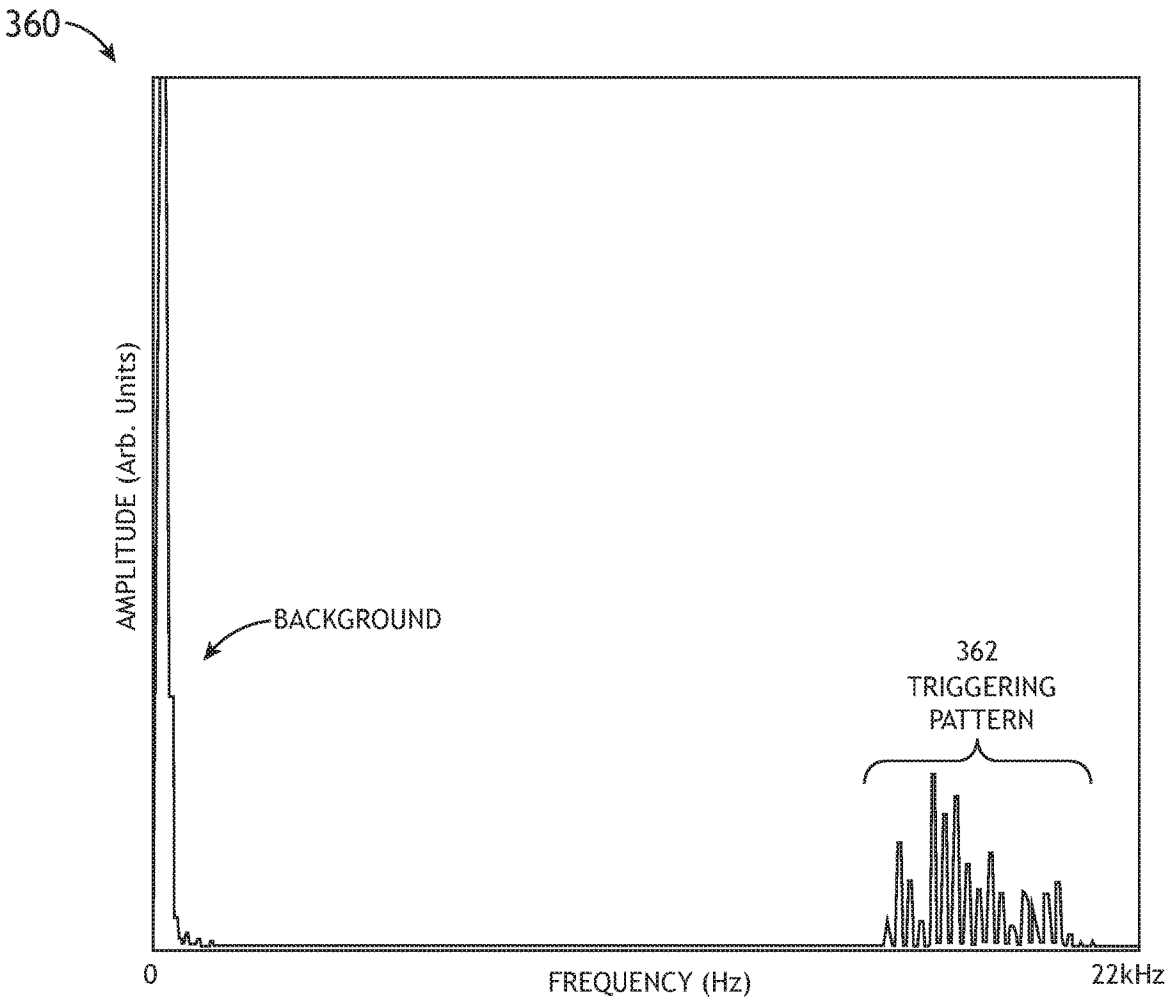
FIG. 3C illustrates a graph of the amplitude of the digital audio signal as a function of frequency in the case where the audio signal includes a triggering pattern, in accordance with one or more embodiments of the present disclosure.

FIG. 3C illustrates a graph 360 of the amplitude of the digital audio signal as a function of frequency in the case where the audio signal contains a triggering pattern, in accordance with one or more embodiments of the present disclosure. For example, the triggering pattern 362 may be inserted into an audio signal (by system 100) by producing a signal having an amplitude at the desired frequencies. For instance, the system 100 may generate an output triggering pattern having a set of non-random predetermined frequencies of a selected amplitude. For instance, the triggering pattern may be generated using non-random frequencies, where there is a selected time (e.g., a selected time of 0.3 s) between a set of M frequency outputs (e.g., 15 frequencies), with each alteration lasting for a selected time (e.g., 1 ms).

It is noted that the sonic triggering pattern(s) 362 may be placed anywhere along the audio spectrum. It is noted herein that most mobile communication devices are capable of detecting sound at least up to 21 kHz, with others being able to detect signals at even higher frequencies (e.g., 24 kHz). Further, the human ear typically has difficulty perceiving signals above 16 kHz, where sounds about 20 kHz are considered beyond human perception and are thus considered "ultrasonic." In some embodiments, the frequencies of the one or more triggering patterns 362 may be selected so as to reside above easy human perception, but yet low enough to ensure the vast majority of mobile devices are capable of picking such signals up. In this example, the one or more triggering patterns 362 may lie within the frequency range of 16-21 kHz. In other embodiments, the frequencies of the one or more triggering patterns 362 may be selected so as to be fully ultrasonic, but yet low enough to ensure the vast majority of mobile devices are capable of picking such signals up. In this example, the one or more triggering patterns 362 may lie within the frequency range of 20-21 kHz.

Figure 3D:
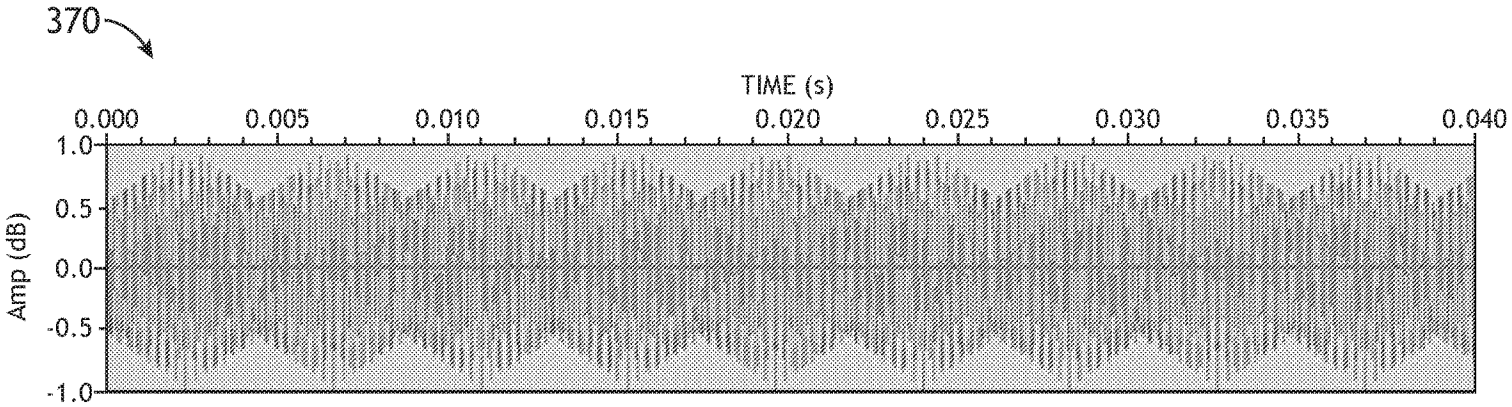
FIG. 3D illustrate a graph of an excerpt of an example ultrasonic triggering pattern in waveform, in accordance with one or more embodiments of the present disclosure.
Figure 3E:
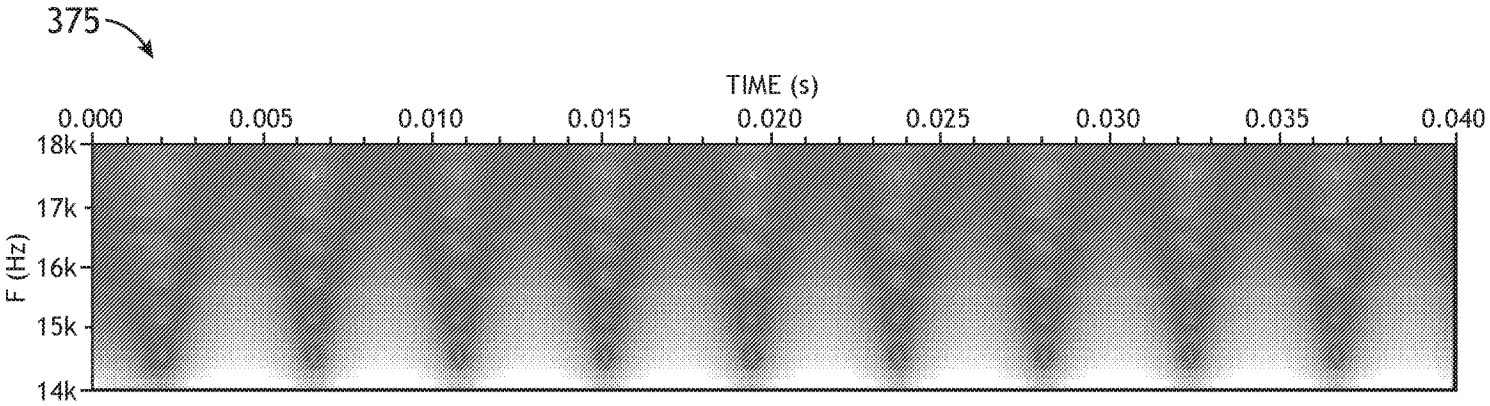
FIG. 3E illustrate a graph of an excerpt of the example ultrasonic triggering pattern in spectrographic form, in accordance with one or more embodiments of the present disclosure.

FIG. 3D illustrate a graph 370 of an excerpt of an example ultrasonic triggering pattern in waveform, in accordance with one or more embodiments of the present disclosure. Graph 370 depicts the amplitude of the waveform as a function of time in seconds. FIG. 3E illustrate a graph 375 of an excerpt of the example ultrasonic triggering pattern in spectrographic form, in accordance with one or more embodiments of the present disclosure. Graph 370 depicts the frequency of the triggering pattern as a function of time.

In step 310, the transformed signal(s) are analyzed. In one embodiment, the transformed audio signals are analyzed to identify the one or more triggering patterns contained in the transformed signal (e.g., triggering pattern 362). For example, the one or more processors 204 may compare the frequency-amplitude vectors derived from the transform (step 308) to various triggering patterns stored in the triggering pattern database (e.g., database 210 of memory 206 or databased maintained in the "cloud"). In this example, the one or more processors 204 may search a triggering pattern database to find a match to the transformed signal from step 308.

As the mobile device 108 decodes the incoming audio, it compares the received audio with a list of pre-stored audio triggering patterns to produce a Boolean result indicating whether or not the incoming audio at that time contained the triggering pattern in question. If the Boolean result is negative for all triggers, the mobile device 108 may continue to listen and decode audio. If, instead, the Boolean result is positive for at least one triggering pattern, the mobile device 108 may record the time in memory 206 that the given triggering pattern was detected.

In one embodiment, each triggering pattern is composed of two or more properties: an identification string and the set of expected frequency-amplitude vectors (following transformation). An example of a triggering pattern database is provided below in Table I.

TABLE I

Triggering Pattern Database

| TRIGGER ID | ANTICIPATED FFT OUTPUT | MARGIN OF ERROR |
|---|---|---|
| 000001 | 00000000....10001000002000000100000020001 | 0.2 |
| 000002 | 00000000....00100100020000002000000200010 | 0.15 |

As shown in Table I, the triggering pattern database may include a trigger identification string (ID number) and the anticipated transform output, where the post-transform output is reduced to a series of 1, 2 and null values across the N number of frequency segments (i.e., frequency buckets). For instance, the frequency spectrum of the incoming audio signal may be divided into 2048 frequency segments. Further, a value of 1 may correspond to a local maximum or peak at that particular frequency segment (i.e., frequency bucket). In the case of a 1-value, the amplitude at that frequency should be relatively high. A value of 2 can indicate a local minimum or valley at that particular frequency segment. In the case of a 2-value, the amplitude at that frequency should be relatively low. A value of 0 may be indicative of a null result used to designate frequencies that will not be used in the post-transform. The sum total of 1, 2, and null values should be equal to N, the number of frequency-amplitude vectors produced via the transform. For example, if N equals 2048, an FFT output consisting of 22 1-values, 22 2-values, and the remainder 0/null-values would be sufficient to ensure that a false positive would be extremely rare.

In another embodiment, the triggering pattern may also have an associated margin of error in order to better account for environmental noise. In this case, the local minimums/maximums detected by the mobile device 108 need only match the local minimums/maximums designated in the database within the margin of error. Using the previous example, with 22 designated local maximums and 22 designated local minimums, with a margin of error of 0.2, only 80% of the designated maximums/minimums must be simultaneously detected in order for the final Boolean output with regard to that specific trigger to be considered positive. This margin of error may be adjusted externally according to preference regarding the balance of triggering ease vs. false positive percentages, venue acoustics and other considerations.

The triggering pattern database 210 may be stored in any memory accessible by the one or more processors 204 of the mobile device 108. In one embodiment, as shown in FIGS. 2B and 2C, the trigger database 210 may include a local memory of the mobile device 108. In another embodiment, the triggering pattern database 210 is stored in a remote memory maintained on a remote server (not shown), such as, but not limited to, a SQL server. In this regard, the mobile device 108 and the remote server (containing the remote trigger database 210) may communicate with each other via a network. In this embodiment, the triggering pattern database 210 may be considered stored in the cloud.

In step 312, one or more actions on the mobile device are executed based on the one or more triggering patterns. For example, when the mobile device 108 recognizes a triggering pattern amidst the noise, the mobile device 108 may record a timestamp for the triggering pattern in memory 206. In turn, the mobile device 108 may execute the action (or series of actions) paired with the detected one or more triggering patterns. In one embodiment, the various triggering pattern IDs may be paired with their associated functions in a pairing database 212, such as that shown below.

TABLE II

| Pairing Database | |
|---|---|
| TRIGGER ID | FUNCTION ID |
| 000001 | 00010, 00011, 00012 |
| 000002 | 00320, 00321, 00323 |

In one embodiment, the pairing database 212 may be accessed immediately after the mobile device 108 detects the triggering pattern. In another embodiment, the pairing database 212 can be periodically checked and downloaded in the background of the mobile device 108 so that there is little to no delay between the mobile device 108 detecting the triggering pattern and the device 108 starting the series of actions associated with that triggering pattern. The latter option is particularly advantageous. For example, if thousands of mobile devices 108 are being synced for a crowd-sourced light show at a sporting event or concert, the mobile devices 108 would not need any sort of connection (WiFi, 4G, 3G, Bluetooth, or cellular data) in the venue so long as the application (i.e., "app") had been installed on the mobile devices 108 beforehand as the trigger-action pairing would have happened prior to the event. Pre-installing the application (and databases) onto the mobile device(s) 108 prior to a given event can be particularly advantageous because many large and/or old venues possess are impermeable to electromagnetic fields (making downloading the application at the event difficult).

The pairing database 212 may be stored in any memory accessible by the one or more processors 204 of the mobile device 108. In one embodiment, as shown in FIGS. 2B and 2C, the pairing database 212 may include a local memory of the mobile device 108. In another embodiment, the pairing database 212 is stored in a remote memory maintained on a remote server (not shown), such as, but not limited to, a SQL server. In this regard, the mobile device 108 and the remote server (containing the remote pairing database 212) may communicate with each other via a network. In this embodiment, the pairing database 212 may be considered stored in the cloud.

Actions controlled by the system 100 via the one or more triggering patterns embedded in the audio signal 106 may include any action executable by the given mobile device(s) 108. For example, the actions that may be executed by the mobile device(s) may include, but are not limited to, turning on/off the LED light, changing screen colors, playing audio, displaying video or images, downloading content, unlocking content, recording video (e.g., if doing a crowd-sourced synchronized light show, record footage of the show), recording audio, or taking pictures (e.g., selfies).

In another embodiment, each action may also have a corresponding time delay. In this regard, the time delay corresponds to the time following the detection of the triggering pattern that the associated action should begin. As such, the mobile device 108 can be given precisely timed commands which may execute in real-time or, alternatively, in delayed-time (e.g., delayed seconds, minutes, hours or days after triggering pattern detection).

The various actions can be contained within an action database similar to the action database provided below in Table III, which also contains the delay time after triggering pattern detection before the associated action starts. Further, as noted previously herein, the various actions may be paired with the triggering patterns as shown in the pairing database of Table II.

TABLE III

| Action Database | | |
|---|---|---|
| ACTION ID | DELAY (s) | ACTION |
| 00010 | 1.24 | TURN SCREEN BLUE (RGB: 0 0 205) OVER THE COURSE OF 2.5 SECONDS |
| 00011 | 4.0 | FLASH LED LIGHT FOR 0.8 SECONDS |
| 00012 | 5.55 | FADE IN PNG IMAGE FROM URL: https://qraider.com/images/etc.png |
| 00013 | 8.0 | VIBRATE DEVICE FOR 0.5 SECONDS |
| 00014 | 0.0 | UNLOCK CONTENT WITH ID 104 |

Figure 3F:
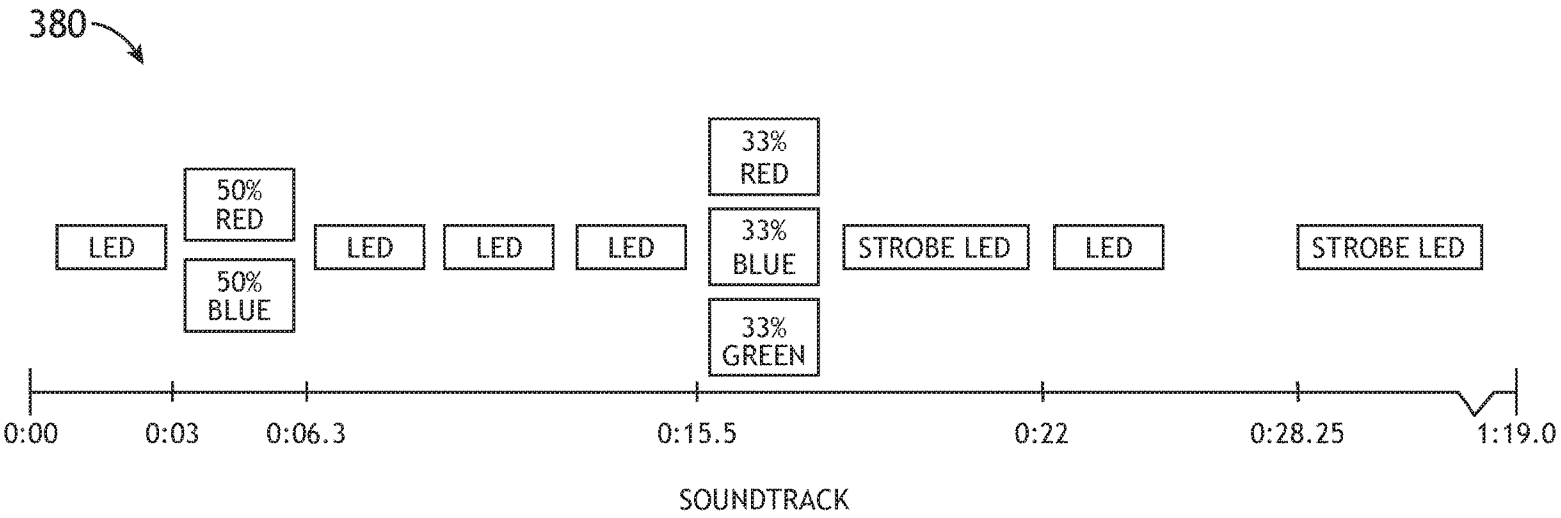
FIG. 3F illustrates a conceptual view of an output timeline of one or more mobile devices, in accordance with one or more embodiments of the present disclosure

FIG. 3F illustrates a conceptual view 380 of an output timeline, of a control sequence, of one or more mobile devices 108, in accordance with one or more embodiments of the present disclosure. As shown in FIG. 3F, the control sequence dictates the activation of various components of the one or more mobile devices 108.

In another embodiment, complex triggers may be formed from a combination of individual triggering patterns. Such complex triggers may be implemented by the system 100/mobile device 108 in order to reduce false triggers or to convey more data. Complex triggers may be created via a permutation of two or more individual trigger patterns. For example, if trigger pattern 0000001, 0000002, 0000003 and 0000004 are all outputted by the system 100 and heard by mobile device 108 then a selected action can be triggered on the mobile device 108.

In another embodiment, a selected time period is used to determine what trigger patterns should be used to form the complex trigger. For example, all of the trigger patterns detected by the mobile device 108 within a selected time period may be used to form the complex trigger. For instance, if the selected time period is 1.5 s and the trigger patterns 0000001, 0000002, 0000004 occur within the 1.5 s period and trigger pattern 0000003 occurs at 3 s then only trigger patterns 0000001, 0000002, and 0000004 are used to form the complex trigger. Then, the mobile device 108 may review a complex trigger database (not shown) that correlates a specific action (or set of actions) with the complex trigger formed from the base triggering patterns 0000001, 0000002 and 0000004.

It is noted that these complex triggers are not limited to the simple execution of the individual actions associated with the individual trigger patterns (e.g., see Table III for individual trigger pattern/function correlation). Rather, the complex triggers of this embodiment may be correlated with completely unique functions and may be implemented to reduce false positives and convey more information. In this way, small number of triggering patterns can be used to execute a large number of actions on the mobile device 108 by permutating the combinations and/or orders of the base triggering patterns.

Once the mobile device(s) 108 detect a triggering pattern, the device 108 may store the date/time in memory 206. It is noted this date/time is computationally precise, with the seconds provided down to four or five decimal places. Once this date is stored in the memory 206 of the device 108, the device 108 can either cease the Fourier transformations of sampled audio or continue to sample and transform audio, awaiting further cues. The stored date marks the initialization of the control sequence (e.g., timeline) of the device 108. For example, the control sequence of the device 108 used to execute a particular audio and/or visual display, with multiple audio and/or visual events sequenced over a period of time for selected durations at selected times. For instance, the initialization of the control sequence may include the start of a light show carried out with the display 220 of the device 108 and/or LED 217 of the device 108, whereby the particular display intensity, duration, intervals and/or color at particular times through the control sequence are stored in memory 206.

In another embodiment, after storing the date in memory 206, the device 108 continuously (or periodically) compares the current time with the stored time, deriving the intervening time period (e.g., number of milliseconds). In one embodiment, this process is executed on a separate thread, so as to leave the main thread available for continued UI response. In the event the time period (e.g., number of milliseconds) is equal to a specified integer pre-programmed in the memory 206, the devices 108 execute the designated control sequence (stored on each device 108). For example, if the stored time (the time at which the device registered the corresponding triggering pattern) were 1.5000 seconds after 7:00 PM and the device had preprogrammed into its memory to flash its built-in light at 1500 milliseconds after the initialization of the timeline, at this moment all mobile communication devices 108 would in synchrony flash their built-in LED light 208. In this regard, an extremely complex and synchronized light show, featuring device vibration, LED flashes, controlled color generation (timing control and spatial control) and/or audio rendering may be initiated by one or more triggering patterns (or single ultrasonic tone).

The output devices of the one or more mobile devices 108 may be used to carry out any number of light shows or displays, such as, but not limited to, coordinated visual celebrations, pixelate shows (where each mobile device acts as a pixel of the stadium-sized display), stadium or arena "roulette" (i.e., rolling wave) where a light pattern rotates about the stadium or arena until finally landing on a particular section. The output devices of the one or more mobile devices 108 may be used to award fans attending the event, listening/watching broadcasts of the event.

It is noted herein that one or more control sequences may be initiated simultaneously or sequentially. In addition, the present disclosure is not limited to the implementation of a light show control sequence and any number of the audio and/or visual output components of the one or more mobile devices 108 may be used to output an audio and/or visual display routine using one or more control sequences stored in memory and initiated through the detection of a triggering audio signal.

In another embodiment, as previously noted, this process may also be carried out on devices 108 located at large remote distances outside the confines of the given event. In this regard, a remote device 108 may acquire an audio signal emitted through a radio or TV speaker. In this regard, devices all over the world can be synchronized. Further, this process may be carried out by analyzing audio signals that are recorded, stored and replayed at a later date.

The ability to receive and decode audio signals outputted from the speaker unit 101 using the one or more mobile devices 108 also allows for event organizers to push messages to the one or more mobile devices 108. In this regard, the various triggering patterns can be associated with alphanumeric characters and/or whole words or phrases. Then, when the one or more mobile devices 108 receive these particular triggering patterns, the processor 204 may search the corresponding database and convert these triggering patterns to text, which may be displayed on the UI of the one or more mobile devices.

In another embodiment, the system 100 may be used to unlock features within an app running on the one or more mobile devices 108, so that the user experience can be expanded, provided the user fulfills the various tasks by which the trigger is heard (e.g., attending a live event such as a sporting event or concert, where a ultrasonic trigger is played at designated times; watching a particular broadcast; tuning in to a radio station, etc.). In another embodiment, products or coupons may be presented or unlocked through a trigger embedded into a commercial. Trivia or other interactive UI components may appear following various audio cues during a film or TV show.

Location-sensing information more accurate than that provided by GPS, or where GPS will not work, may also be garnered using the embodiments of the present disclosure. For example, interactive indoor maps showing user location can even be displayed (e.g., based on triggering patterns/tones emitted by strategically placed speakers). Location-aware messages and notifications may also be displayed, providing various utility not currently offered by more generalized methods such as Apple's Push Notification Service or Google's Cloud Messaging and Firebase. For example, a speaker/audio-beacon can be set up at a specific exhibit in a museum to offer additional insight and provide a more interactive visitor experience. Speakers or audio-beacons may be placed in shopping malls or other commercial centers, emitting a trigger every few seconds, in order to interact with users, e.g., by providing a map or redeemable coupons.

Embodiments of the present disclosure also enable two mobile devices to communicate acoustically with no more specialized hardware than the microphones, processors, and speakers located on-board most mobile communications devices. The sonic fingerprint can also be used for authentication and authorization purposes. A new sonic fingerprint can be generated ad hoc for one-time use, for example, to use in payment processing. Private keys are in general long strings of alphanumeric characters. Such keys can be replaced with a unique transform (e.g., FFT) output of a randomly generated sonic fingerprint. The text version of which (e.g., 00001000000200020010020002001 . . . ) can be used for long distance server-to-client communication, but the sonic version of which can be used over short-ranges. For example, two nearby portable devices may transmit IP addresses and port numbers via an ad-hoc ultrasonic fingerprint and open real-time peer-to-peer communication using a common network All of the methods described herein may include storing results of one or more steps of the method embodiments in memory. The results may include any of the results described herein and may be stored in any manner known in the art. The memory may include any memory described herein or any other suitable storage medium known in the art. After the results have been stored, the results can be accessed in the memory and used by any of the method or system embodiments described herein, formatted for display to a user, used by another software module, method, or system, etc. Furthermore, the results may be stored "permanently," "semi-permanently," temporarily, or for some period of time. For example, the memory may be random access memory (RAM), and the results may not necessarily persist indefinitely in the memory.

Those having skill in the art will recognize that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

In some implementations described herein, logic and similar implementations may include software or other control structures. Electronic circuitry, for example, may have one or more paths of electrical current constructed and arranged to implement various functions as described herein. In some implementations, one or more media may be configured to bear a device-detectable implementation when such media hold or transmit device-detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or invoking circuitry for enabling, triggering, coordinating, requesting, or otherwise causing one or more occurrences of virtually any functional operations described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit). Those skilled in the art will recognize how to obtain, configure, and optimize suitable transmission or computational elements, material supplies, actuators, or other structures in light of these teachings.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, those skilled in the art will recognize that the various embodiments described herein can be implemented, individually and/or collectively, by various types of electro-mechanical systems having a wide range of electrical components such as hardware, software, firmware, and/or virtually any combination thereof; and a wide range of components that may impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs. Those skilled in the art will also appreciate that examples of electro-mechanical systems include but are not limited to a variety of consumer electronics systems, medical devices, as well as other systems such as motorized transport systems, factory automation systems, security systems, and/or communication/computing systems. Those skilled in the art will recognize that electro-mechanical as used herein is not necessarily limited to a system that has both electrical and mechanical actuation except as context may dictate otherwise.

In a general sense, those skilled in the art will recognize that the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). Those having skill in the art will recognize that the subject matter described herein may be implemented in an analog or digital fashion or some combination thereof.

Those skilled in the art will recognize that at least a portion of the devices and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly intractable, and/or wirelessly interacting components, and/or logically interacting, and/or logically intractable components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein. It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B".

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed:

1. A system comprising:

a controller, the controller including one or more processors configured to execute a set of program instructions stored in memory, wherein the set of program instructions cause the one or more processors to generate an inaudible audio signal including one or more audio triggering patterns; and a speaker unit, wherein the speaker unit is communicatively coupled to the one or more processors of the controller, wherein the speaker unit is configured to output the inaudible audio signal including the one or more audio triggering patterns to one or more mobile devices, wherein the one or more audio triggering patterns correspond with one or more actions executable by the one or more mobile devices.

2. The system of claim 1, wherein the one or more audio triggering patterns comprise:

one or more ultrasonic audio triggering patterns.

3. The system of claim 1, wherein the one or more audio triggering patterns comprise:

one or more audio triggering patterns within the frequency range of 14-24 kHz.

4. The system of claim 3, wherein the one or more audio triggering patterns comprise:

one or more audio triggering patterns within the frequency range of 20-21 kHz.

5. The system of claim 1, wherein the two or more audio triggering patterns form a complex trigger.

6. The system of claim 1, wherein the set of program instructions cause the one or more processors to:

generate an audible audio signal.

7. The system of claim 6, wherein the speaker unit is configured to output the audible audio signal, wherein the audible audio signal and the inaudible audio signal are output simultaneously.

8. The system of claim 6, wherein the set of program instructions cause the one or more processors to append the inaudible audio signal containing the one or more triggering patterns to the an audio track containing the audible audio signal.

9. The system of claim 1, wherein the one or more mobile devices comprise:

at least one of a smartphone, a tablet, a laptop, a personal digital assistant (PDA), a wearable device or a customized mobile communication device.

10. The system of claim 1, wherein the speaker unit is located locally with respect to the controller.

11. The system of claim 1, wherein the speaker unit is located remotely with respect to the controller.

12. The system of claim 1, wherein the one or more actions executable by the one or more mobile devices comprise:

at least one of activation or adjustment of one or more LED flash devices of the one more mobile devices.

13. The system of claim 1, wherein the one or more actions executable by the one or more mobile devices comprise:

at least one of activation or adjustment of one or more displays of the one or more mobile devices.

14. The system of claim 1, wherein the one or more actions executable by the one or more mobile devices comprise:

at least one of activation or adjustment of one or more speakers of the one or more mobile devices.

15. The system of claim 1, wherein the one or more actions executable by the one or more mobile devices comprise:

at least one of activation or adjustment of one or more vibrational elements of the one or more mobile devices.

16. The system of claim 1, wherein the one or more actions executable by the one or more mobile devices comprise:

acquisition of at least one of an image, video or a sound with a camera of the one or more mobile devices.

17. A system comprising:

a controller, the controller including one or more processors configured to execute a set of program instructions stored in memory, wherein the set of program instructions cause the one or more processors to generate an inaudible audio signal including one or more ultrasonic audio triggering patterns; and a speaker unit, wherein the speaker unit is communicatively coupled to the one or more processors of the controller, wherein the speaker unit is configured to output the inaudible audio signal including the one or more ultrasonic audio triggering patterns to one or more mobile devices, wherein the one or more ultrasonic triggering patterns correspond with one or more actions executable by the one or more mobile devices.

18. A system comprising:

a first mobile communication device comprising:

a microphone;

one or more processors; and memory, wherein the one or more processors are configured to execute a set of program instructions stored in the memory, wherein the set of program instructions cause the one or more processors of the first mobile communication device to:

transform at least a portion of an inaudible audio signal received by the microphone to a transformed signal containing a set of frequency-amplitude vectors analyze the transformed inaudible audio signal to identify one or more ultrasonic audio triggering patterns in the transformed signal; and upon identifying the one or more ultrasonic audio triggering patterns, executing one or more actions of one or more control sequences on the mobile device associated with the one or more ultrasonic audio triggering patterns.

19. The system of claim 18, wherein the one or more control sequences cause the selective activation of at least one of an audio component or visual component of the first mobile communication device.

20. The system of claim 19, further comprising:

a second mobile communication device comprising:

a microphone;

one or more processors; and memory, wherein the one or more processors are configured to execute a set of program instructions stored in the memory, wherein the set of program instructions cause the one or more processors of the second mobile communication device to:

receive the inaudible audio signal;

transform at least a portion of the inaudible audio signal to the transformed signal containing the set of frequency-amplitude vectors;

analyze the transformed inaudible audio signal to identify the one or more audio triggering patterns in the transformed signal; and upon identifying the one or more audio triggering patterns, executing one or more actions of one or more control sequences on the second mobile device associated with the one or more audio triggering patterns.

21. The system of claim 20, wherein the one or more control sequences causes the selective activation of at least one of an audio component or visual component of the second mobile communication device.

22. The system of claim 21, wherein the selective activation of at least one of an audio component or visual component of the second mobile communication devices is synchronous to the selective activation of at least one of an audio component or visual component of the first mobile communication devices.

23. The system of claim 21, wherein in the selective activation of at least one of an audio component or visual component of the second mobile communication devices is coordinated with respect to the selective activation of at least one of an audio component or visual component of the first mobile communication devices.

24. The system of claim 20, wherein at least one of the first mobile devices or the second mobile device comprises:

at least one of a smartphone, a tablet, a laptop, a personal digital assistant (PDA), a wearable device or a customized mobile communication device.

25. The system of claim 20, wherein the one or more actions comprise:

at least one of activation or adjustment of one or more LED flash devices of at least one of the first mobile device or the second mobile device.

26. The system of claim 20, wherein the one or more actions comprise:

at least one of activation or adjustment of one or more displays of at least one of the first mobile device or the second mobile device.

27. The system of claim 20, wherein the one or more actions comprise:

at least one of activation or adjustment of one or more speakers of at least one of the first mobile device or the second mobile device.

28. The system of claim 20, wherein the one or more actions comprise:

at least one of activation or adjustment of one or more vibrational elements of at least one of the first mobile device or the second mobile device.

29. The system of claim 20, wherein the one or more actions comprise:

acquisition of at least one of an image, video or a sound with a camera of at least one of the first mobile device or the second mobile device.

30. The system of claim 18, wherein the one or more audio triggering patterns comprise:

one or more ultrasonic audio triggering patterns.

31. The system of claim 18, wherein the one or more audio triggering patterns comprise:

one or more audio triggering patterns within the frequency range of 14-24 kHz.

32. The system of claim 31, wherein the one or more audio triggering patterns comprise:

one or more audio triggering patterns within the frequency range of 20-21 kHz.

33. The system of claim 18, wherein two or more audio triggering patterns form a complex trigger.

34. A system comprising:

a first mobile communication device;

a second mobile communication device, wherein at least one of the first mobile communication device or the second mobile communication device comprises:

a microphone;

a speaker unit;

one or more processors; and memory, wherein the one or more processors are configured to execute a set of program instructions stored in the memory, wherein the set of program instructions of the first mobile device cause the one or more processors of the first mobile device to:

transform at least a portion of an inaudible audio signal received by the microphone of the first mobile communication device from the speaker unit of the second mobile device to a transformed signal containing a set of frequency-amplitude vectors;

analyze the transformed inaudible audio signal to identify one or more ultrasonic audio triggering patterns in the transformed signal;

upon identifying the one or more ultrasonic audio triggering patterns, search a database to identify at least one of one or more alphanumeric characters, one or more words, or one or more phrases associated with the one or more identified ultrasonic audio triggering patterns; and display at least one of the one or more alphanumeric characters, the one or more words, or the one or more phrases associated with the one or more identified ultrasonic audio triggering patterns on a user interface of the first mobile communication device.

35. The system of claim 34, wherein the set of program instructions of the second mobile device cause the one or more processors of the second mobile device to:

transform at least a portion of an inaudible audio signal received by the microphone of the second mobile communication device from the speaker unit of the first mobile device to a transformed signal containing a set of frequency-amplitude vectors;

analyze the transformed inaudible audio signal to identify one or more ultrasonic audio triggering patterns in the transformed signal; and upon identifying the one or more ultrasonic audio triggering patterns, search a database to identify at least one of one or more alphanumeric characters, one or more words, or one or more phrases associated with the one or more identified ultrasonic audio triggering patterns; and display at least one of the one or more alphanumeric characters, the one or more words, or the one or more phrases associated with the one or more identified ultrasonic audio triggering patterns on a user interface of the second mobile communication device.

* * * * *